United States Patent [19]

Akhavi et al.

[11] Patent Number: 4,551,949

[45] Date of Patent: Nov. 12, 1985

[54] METHOD AND APPARATUS FOR DISSIPATING STATIC CHARGE FROM AN ABRASIVE TUMBLING OPERATION

[75] Inventors: David S. Akhavi, Westwood; Richard W. Cudworth, Upland; John R. Kniffin, Mira Loma, all of Calif.

[73] Assignee: Iolab Corporation, Covina, Calif.

[21] Appl. No.: 620,237

[22] Filed: Jun. 13, 1984

[51] Int. Cl.[4] ..... B24B 31/02

[52] U.S. Cl. ..... 51/164.1; 51/316; 51/7

[58] Field of Search ..... 51/164.1, 164.2, 163.1, 51/163.2, 7, 313, 314, 316

[56] References Cited

U.S. PATENT DOCUMENTS 2,881,571 4/1959 Granata ..... 51/314

3,589,080 6/1971 Abbey ..... 51/314

3,726,046 4/1973 Dreher ..... 51/164.1

FOREIGN PATENT DOCUMENTS 566716 7/1977 U.S.S.R. ..... 51/316

*Primary Examiner*—Harold D. Whitehead

*Attorney, Agent, or Firm*—Donal B. Tobin

[57] ABSTRACT

A process and apparatus for dissipating static electrical charge that may build up on the small plastic parts, the tumbling medium or the tumbling chamber itself during an abrasive tumbling process and cause the parts to be repelled out of the abrasive medium. A flow of ionized gas is distributed about the tumbling chamber, discharges the parts and provides a mechanical action to return the parts to the abrasive medium. This flow of ionized gas dissipates the static charge.

22 Claims, 4 Drawing Figures

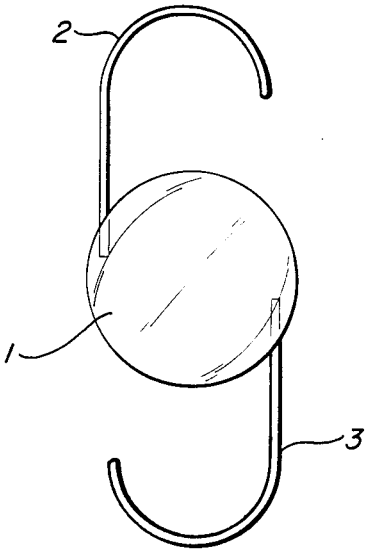
FIG-1
FIG-2
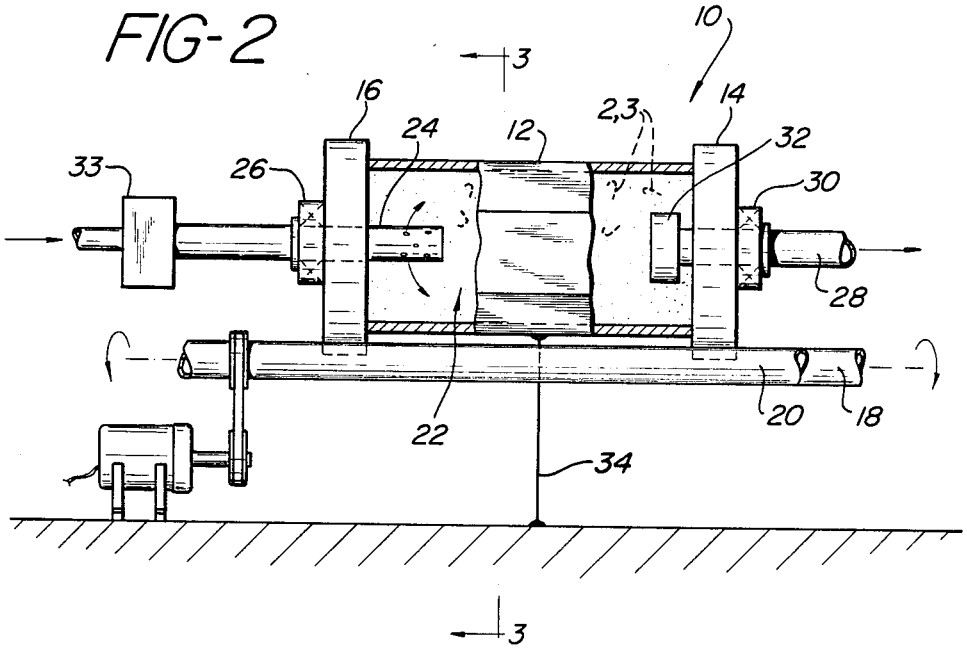

METHOD AND APPARATUS FOR DISSIPATING STATIC CHARGE FROM AN ABRASIVE TUMBLING OPERATION

FIELD OF THE INVENTION

The present invention relates to a method and apparatus for dissipating the static electrical charge that may build up on small plastic parts during an abrasive tumbling operation and, more particularly, to dissipating that charge by introducing a distributed flow of ionized gas into the tumbling chamber.

BACKGROUND OF THE INVENTION

The rough edges of small plastic parts may be polished by a process known as abrasive tumbling. The parts are placed in a rotating chamber together with an abrasive medium, and the mixing of the medium and the parts will smooth and polish the parts. During the tumbling process, a static electrical charge often builds up on the tumbling chamber, the medium and the tumbled parts. If the parts are relatively large, this does not cause any significant problem. However, if the parts are very small, the static charge can tend to repell the small plastic parts out of the abrasive medium so as to defeat the purpose of the tumbling process.

Very small plastic parts are used for devices known as intraocular lenses. It is commonly accepted that the vision-impairing disease known as cataracts can be alleviated by surgically replacing the natural lens of the eye with an artificial intraocular lens. Intraocular lenses have two principal parts: a medial, light-focusing body (also known as the optic) made of a non-toxic, plastic material which will replace the natural lens of the eye and focus light on the retina. Certain types of intraocular lenses include plastic supports (also known as haptics) which extend from the optic to the anatomy of the eye and provide means for fixing and holding the optic in proper position within the eye. These haptic supports can be made of tiny filaments of flexible, memory-retaining plastic, for example, polypropylene or some other plastic fibrous material attached to the optic by a variety of methods. Holes can be drilled into the edge of the optic, and the end of the haptic filament can be bonded, glued or crimped into these holes. There are a variety of other methods for attaching the haptics to the optic.

A well-known lens in which small haptic filaments are affixed to the optic is shown in U.S. Pat. No. 4,159,546. This lens is popularly known as the Shearing or J-loop lens. Such a lens is shown in FIG. 1 of the present invention wherein the optic is designated by reference character 1, and the haptic filaments are designated as reference characters 2 and 3. The diameter of the haptic filaments can be as small as 0.006 inches, and the length of the haptic filaments can be in the vicinity of 6 millimeters.

Before these haptic filaments are attached to the optic, any sharp edges must be polished away to minimize irritation to the internal anatomy of the eye. One process for providing this polishing is to tumble the filaments in an abrasive medium. Because the filaments are so small and light, the static electrical charge which they tend to pick up during tumbling can cause the filaments to migrate out of the tumbling medium and either float freely in the tumbling chamber or cling to the interior wall of the chamber.

It would be desirable to have an apparatus and a method for dissipating the static electrical discharge that may build up on the tumbling medium and the haptic filaments so that the haptic filaments will tend to stay within the tumbling medium and be properly smoothed and rounded.

SUMMARY OF THE PRESENT INVENTION

The present invention provides a method and apparatus for dissipating the static electric charge that may build up on small plastic haptic filaments for intraocular lenses during an abrasive tumbling procedure which is used to smooth and round the surfaces of the haptic filaments before they are attached to the optic.

The apparatus of the present invention includes a chamber having a polyhedronal cross-section with first and second ends attached to the chamber. The ends have a generally circular cross-section. The circular ends of the chamber rest on roller bars, one or both of which turn to rotate the chamber. A quantity of abrasive medium is placed inside the chamber together with a quantity of haptic filaments which are to be polished during the abrasive tumbling. The chamber includes an inlet which is inserted through one of the circular ends through a sealed roller bearing which permits the chamber to rotate while the inlet remains fixed. Fluid is introduced through the inlet into the chamber and is adapted to dissipate the static charge that may build up on the parts and the medium during the tumbling process. The fluid is then exhausted from the chamber. The fluid may be an ionized diatomic gas, like nitrogen, oxygen or even air, which is taken from a source of gas under pressure and directed through an ionizing element and then into the chamber. The inlet to the chamber may include a distributor head which is a generally annular tube with one open end in fluid communication with the inlet and a closed end. The annular wall of the distributor head has a number of openings distributed about its circumference. The openings are aligned in different directions to provide streams of fluid that are directed about the inside of the chamber to provide a flow of electrostatic-charge-dissipating fluid and also to provide a mechanical mixing action to return small plastic parts which may have been repelled out of the abrasive medium by their static charge back into the medium.

The fluid is directed into the chamber under pressure in the range of 5 to 15 psi. gauge and more preferably in the range of 5 to 10 psi. gauge and at a flow rate of approximately 120 to 200 liters per hour and more preferably 162 liters per hour.

The tumbling medium is usually glass beads of a variety of sizes with no appreciable amounts of liquid.

After the fluid is distributed throughout the chamber, it is exhausted through a stainless steel, wire mesh filter which has openings smaller than the minimum size of the parts that are subjected to the abrasive tumbling so that none of the parts will be exhausted from the chamber with the flow of gas.

The process of the present invention includes introducing into a tumbling chamber a flow of fluid adapted to dissipate static electrical charge that may build up within the tumbling chamber, on the parts themselves or on the tumbling medium. Since these parts are very small, the static charge that they pick up during tumbling may be sufficient to repell them out of the abrasive medium. The flow is distributed around the chamber to provide thorough mixing to thoroughly dissipate the static charge and to provide a mechanical action for returning the small plastic parts to the tumbling medium.

In an alternative embodiment, a pellet of ionizing material may be placed directly within the chamber, for example on the end of the inlet, to further enhance the ion concentration of the fluid within the chamber.

These and other features and advantages of the present invention will become apparent when taken in conjunction with the following detailed description of the preferred embodiment and the following drawings.

BRIEF DESCRIPTION OF THE DRAWINGS

FIG. 1 shows a schematic representation of an intraocular lens;

FIG. 2 shows a schematic representation of the present invention;

DETAILED DESCRIPTION OF THE PREFERRED EMBODIMENT

Figure 3:
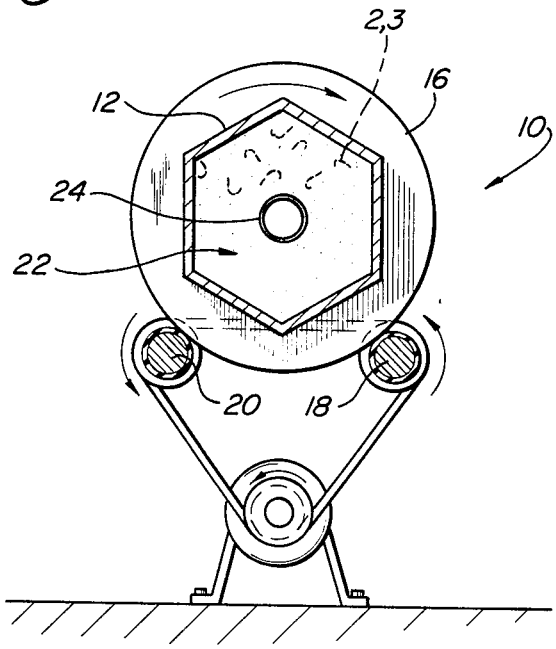
FIG. 3 shows a schematic cross-sectional view of the present invention taken along lines 3—3 in FIG. 2; and, FIG. 4 shows an enlarged perspective view of a part of the invention shown in FIG. 2.

Referring now to FIG. 1 there is shown a schematic view of a typical intraocular lens having optic 1 and haptic support filaments 2 and 3. The diameter of optic 1 is typically about 6 millimeters. The maximum dimension of the entire lens, including the optic and its attached support filaments, is typically 12 to 15 millimeters. The diameter of haptic filaments 2 and 3 is typically about 0.006 inches. As previously explained, haptics 2 and 3 can be manufactured as separate parts and then affixed to optic 1. Before haptics 2 and 3 are affixed to optic 1, it is necessary to smooth and round all of their surfaces to minimize the irritation they may cause to the internal anatomy of the eye. This rounding and smoothing can be efficiently accomplished in an abrasive tumbling operation.

Referring now to FIG. 2, there is shown a schematic representation of the abrasive tumbler of the present invention. Tumbler 10 includes a hollow chamber 12 with a generally polyhedronal cross-section, preferably hexagonal cross-section, which is attached to first and second end pieces 14 and 16, respectively, which have generally circular cross-sections. Cylindrical end pieces 14 and 16 have a diameter greater than the largest diameter of chamber 12. As shown in FIG. 2, tumblers 14 and 16 may be placed on rollers 18 and 20, one or both of which may be driven so that the tumbler 10 will rotate about its axis.

An abrasive medium 22 is placed within tumbler 10 together with a quantity of haptic filaments 2 and 3 for abrasive tumbling.

Abrasive tumbling medium 22 is primarily composed of glass beads of various sizes and includes no water. The tumbling medium is dry and is not composed of a slurry.

Intake tube 24 extends through end piece 16. Bearing 26 is provided to permit tumbler 10 to rotate while intake tube 24 remains fixed.

Exhaust tube 28 extends through end piece 14 and is similarly mounted in exhaust bearing 30 to permit end piece 14 to rotate with tumbler 10 while exhaust tube 28 remains fixed. Alternatively, exhaust tube 28 may be omitted and replaced with merely an opening in end piece 14. Filter 32 is placed upstream of exhaust tube 28. The filter medium is preferably made of a very fine mesh stainless steel screen which has openings less than the minimum diameter of filaments 2 and 3, that is, a dimension less than 0.006 inches.

A stream of fluid, preferably a diatomic gas like nitrogen, oxygen or air is introduced into intake tube 24 and passed through an ionized air source 33 leased from Minnesota Mining and Manufacturing Company as Model #906 Ionized Air Source. This ionized air source 33 turns the flow of nitrogen gas into nitrogen ions, both plus and minus ions, by permitting the nitrogen molecules to be bombarded by alpha and beta particles as they proceed through the ionized air source in the proximity of a quantity of Polonium 210 contained within the ionized air source. Polonium 210 is a source of alpha and beta particles with a half life of about 138 days. As the alpha particles come in contact with the nitrogen molecules, the positively charged alpha particles are attracted toward a negatively charged electron of a nitrogen molecule and knock electrons out of the molecule leaving it with an overall positive charge to create a positive ion. As the beta particles, which are essentially a stream of electrons, are attracted to the nucleus of the nitrogen molecule, they tend to knock protons off the nucleus and create a negatively charged particle or a negative ion. The nitrogen ions continue out through intake tube 24 into the interior of chamber 12. The positively and negatively charged ions are then available to interact with the positive and negative charges on tumbling medium 22 and on the small plastic parts to discharge the medium and the parts to allow the parts to fall back into medium 22 and continue to be abrasively tumbled. No net charge is introduced by the diatomic gas. The imbalance of charge caused by the tumbling process is cancelled by the diatomic gas.

Thus, it can be seen that this stream of nitrogen ions is capable of discharging the static charge that may build up in chamber 12 during the tumbling process.

It is possible to use nitrogen, oxygen or ordinary air or any other diatomic gas.

Any static discharge which tends to build up on the stainless steel chamber 12 is removed by a ground 34 attached to chamber 12.

Figure 4:
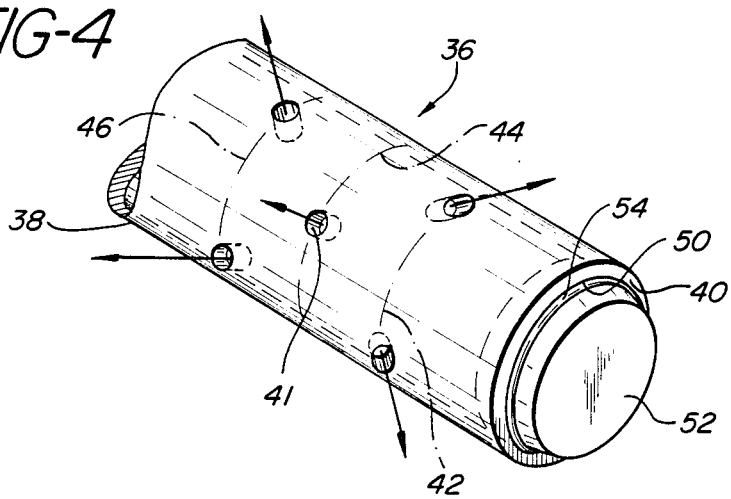

Referring now to FIG. 4 there is shown a distributor head 36 which forms the end of intake tube 24. Intake tube 24 is preferably a hollow tube about 2 inches in inside diameter with sidewall 38 and a closed end 40. The portion of distributor head 36 near end 40 has a large number of injection jets 41 extending through sidewall 38 through which the nitrogen ions flow out of tube 36 into chamber 12. It can be seen, particularly in FIG. 4, that injection jets 41 are arrayed in preferably three rings of four jets each. The first ring 42 of injection jets closest to end 40 are generally cylindrical bores through wall 38, whose axes form an angle of approximately 45° to the axis of distributor head 36 pointing forward in the direction of closed end 40. The second ring 44 of injection jets 41 also include cylindrical bores through wall 38 whose axes are generally perpendicular to the axis of distributor head 36. The third ring 46 of injection jets 41 similarly has cylindrical bores through wall 38 whose axes form an angle of about 45° to the axis of distributor head 36 pointing away from closed end 40. It will be appreciated that ionized nitrogen gas coming into chamber 12 through distributor head 36 will be directed in a variety of jets throughout chamber 12. This distributed fluid flow, in addition to providing a means for dissipating the static electrical charge from the small plastic parts and from medium 22, also provides a mechanical flow for directing the small plastic parts back into abrasive medium 22. The direction and number of these holes has been chosen to provide what is believed to be satisfactory results. However, various infection jet configurations could be used and various arrays of jets could be used.

The gas is directed into chamber 12 under pressure of between 5 and 15 pounds per square inch gauge pressure and, more preferably, between 5 and 10 pounds per square inch gauge pressure. The flow rate is empirically determined to be between 120 and 200 liters per hour and most preferably 162 liters per hour.

It can also been seen in FIG. 4 that closed end 40 includes a recess 50 in which a small pellet 52 is held by means of an O-ring 54. Pellet 52 will be exposed to the interior of chamber 12. Pellet 52 is an additional quantity of the ionizing element Polonium 210 which is used to augment the presence of nitrogen ions within the chamber. The pellet or button 52 of Polonium 210 has a rating of 10 milli curies.

The 3M Model #906 ionized air source 33 has a 20 millicurie rating.

In operation a quantity of haptic filaments 2 and 3 is introduced into chamber 12 with a desired quantity of abrasive medium 22. The tumbler is then started tumbling at a rotative speed of 40 to 45 rpm. for approximately 20 hours. It has been observed that the haptic filaments tumbled in this medium for these periods of time have smooth rounded edges and stay in the abrasive medium rather than develop a static discharge and float free of the medium.

The present invention has been described in conjunction with preferred embodiments. Those skilled in the art will appreciate that many modifications and changes may be made to the preferred embodiments without departing from the scope of the present invention. It is, therefore, not intended to limit the present invention except as set forth in the claims.

We claim:

1. In the process of smoothing tiny plastic parts by tumbling in an abrasive medium within a chamber of polyhedronal cross-section, the improvement comprising:

providing an inlet into said chamber;

introducing into said inlet a flow of ionized fluid to dissipate a static electrical charge that builds up on said parts and on said abrasive medium during the tumbling action thereby and cause said parts to be repelled out of said medium;

providing an outlet from said chamber;

exhausting said flow through said outlet.

2. The process of claim 1 further including the process of distributing said flow throughout said chamber to facilitate the dissipation of said static electrical charge and to provide a mechanical action for returning said parts to said medium.

3. The process of claim 1 further including the step of providing a filter upstream of said exhaust to prevent said small plastic parts from being exhausted from the chamber with the flow.

4. The process of claim 1 wherein said fluid flow includes a flow of ionized gas.

5. The process of claim 4 wherein said ionized gas is selected from the group of gases that form a two atom molecule.

6. The process of claim 4 wherein said ionized gas is selected from the group including nitrogen, oxygen and air.

7. The process of claim 1 further including the step of placing a source of ions within said chamber to augment the charge dissipation properties of said fluid flow.

8. The process of claim 4 further including the step of providing a source of charged particles outside said chamber in fluid communication with said inlet to provide a medium for dissipating said static charge.

9. The process of claim 1 wherein said fluid flow is introduced into said chamber under pressure, said pressure being in the range of 5 to 15 psi gauge.

10. The process of claim 9 wherein said pressure is preferably in the range of 5 to 10 psi gauge.

11. In an apparatus for smoothing tiny plastic parts by tumbling in an abrasive medium having a chamber of polyhedronal cross-section and having first and second ends attached to said chamber, said ends having a generally circular cross-section, and having roller bars adapted to operatively engage said first and second ends to rotate said chamber, the improvement comprising:

inlet means extending through and coaxially aligned with said first end;

sealed bearing means for permitting said chamber and said ends to rotate while said inlet remains fixed;

means in fluid communication with said inlet for introducing into the chamber a flow of ionized fluid to dissipate a static electrical charge which builds up on said parts and said medium during tumbling causing said parts to be repelled from said medium;

exhaust means from said chamber.

12. The apparatus of claim 11 wherein said exhaust means includes an exhaust tube coaxially align with and extending through said second end wall; and, sealed bearing means for permitting said chamber to rotate while said exhaust tube remains fixed.

13. The apparatus of claim 11 further including filter means upstream of said exhaust means for prohibiting said small plastic parts from being exhausted from said chamber with said fluid flow.

14. The apparatus of claim 12 further including a filter means upstream of said exhaust and connected thereto.

15. The apparatus of claim 13 wherein said filter means includes a stainless steel mesh having openings smaller than the minimum diameter of said small plastic parts.

16. The apparatus of claim 11 wherein said means for introducing a fluid flow into said chamber includes:

a source of ionized gas.

17. The apparatus of claim 16 wherein said source of ionized gas includes a source of gas under pressure;

a source of ions in fluid communication with said source of gas through which said gas flows to become ionized.

18. The apparatus of claim 1 further including an ionizing element disposed within said chamber to augment the dissipation of said static charge by said fluid flow.

19. The apparatus of claim 11 further including means for distributing said flow throughout said chamber to facilitate said discharge and to provide a mechanical action to return said parts to said medium.

20. The apparatus of claim 19 wherein said distributor means includes:

a generally cylindrical distributor head having a surrounding annular wall, a first open end in fluid communication with said inlet and a second closed end;

said surrounding annular wall of said distributor head having a plurality of injection openings distributed thereabout and aligned in a plurality of directions with respect to the axis of said distributor head and providing means for introducing a corresponding plurality of streams of said flow into said chamber.

21. The apparatus of claim 20 wherein said holes in said distributor head are arranged in first, second and third rings about the circumference of said surrounding wall, one set of said holes arranged perpendicular to the axis of said head, a second set of said holes arranged at an acute angle to the axis of said head pointing into said chamber and said third set of holes arranged at an acute angle to the axis of said head and pointing toward said inlet.

22. The apparatus of claim 11 wherein said tumbler is made of an electrically conductive material such as stainless steel; and, further including grounding means attached to said tumbler to dissipate static electrical charge which may tend to build up on said tumbler.

* * * * *